US008292448B2

(12) United States Patent
Kim et al.

(10) Patent No.: US 8,292,448 B2
(45) Date of Patent: Oct. 23, 2012

(54) FLAT LIGHTING ASSEMBLY APPARATUS INCLUDING FLAT LIGHTING MODULE

(75) Inventors: Hwayoung Kim, Seoul (KR); Jin Wook Kim, Seoul (KR); Hyunha Shin, Seoul (KR); Sang Hoon Lee, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/116,072

(22) Filed: May 26, 2011

(65) Prior Publication Data

US 2011/0222293 A1 Sep. 15, 2011

(30) Foreign Application Priority Data

Sep. 24, 2010 (KR) ..... 10-2010-0092944
Sep. 24, 2010 (KR) ..... 10-2010-0092945
Sep. 24, 2010 (KR) ..... 10-2010-0092946
Sep. 27, 2010 (KR) ..... 10-2010-0092947

(51) Int. Cl.
*G09F 13/04* (2006.01)

(52) U.S. Cl. ..... 362/97.3; 362/97.1; 362/311.02

(58) Field of Classification Search ..... 362/294, 362/311.02, 296.01, 97.3
See application file for complete search history.

(56) References Cited

U.S. PATENT DOCUMENTS

| | | | | |
|---|---|---|---|---|
| 7,481,569 | B2 * | 1/2009 | Chang | 362/633 |
| 7,658,504 | B2 * | 2/2010 | Moriyasu et al. | 362/97.3 |
| 2007/0053176 | A1 * | 3/2007 | Chou | 362/97 |
| 2007/0086179 | A1 * | 4/2007 | Chen et al. | 362/27 |

FOREIGN PATENT DOCUMENTS

| | | |
|---|---|---|
| JP | 2001-202817 | 7/2001 |
| JP | 2007-335371 | 12/2007 |
| JP | 2009-016052 | 1/2009 |
| JP | 2010-129212 | 6/2010 |
| JP | 2010-198859 | 9/2010 |
| KR | 1020090093493 | 9/2009 |

* cited by examiner

*Primary Examiner* — Evan Dzierzynski
(74) *Attorney, Agent, or Firm* — Lowe Hauptman Ham & Berner, LLP

(57) ABSTRACT

A flat lighting module includes: a frame including a base and an extension portion extending from the base; a light source unit placed on the base that includes a plurality of light emitting devices; and a diffusion plate placed on the light source unit, wherein a light emitting device that is the closest to the extension portion among the plurality of the light emitting devices of the light source unit is disposed separately from the extension portion at a predetermined interval.

18 Claims, 5 Drawing Sheets

FLAT LIGHTING ASSEMBLY APPARATUS INCLUDING FLAT LIGHTING MODULE

The present application claims priority under 35 U.S.C. §119 to Korean Patent Applications 10-2010-0092944, 10-2010-0092945, 10-2010-0092946 and 10-2010-0092947, all filed on Sep. 24, 2010, the entirety of which is hereby incorporated by reference.

TECHNICAL FIELD

The present disclosure relates to a flat lighting module and a flat lighting assembly apparatus including the same.

BACKGROUND

In general, an electric bulb or a fluorescent lamp is commonly used as an indoor or outdoor lighting lamp. However, the electric bulb or the fluorescent lamp has a short life span, so that it should be frequently changed. Moreover, a conventional fluorescent lamp degrades due to the time it is used. As a result, often its illuminance is gradually decreased.

In order to overcome such problems, a lighting apparatus is now being developed by using a light emitting device (hereinafter, referred to as LED). The LED is easy to control and has a rapid response speed, high electro-optic conversion efficiency, a long life span, low power consumption and high luminance. The LED is also used to create emotional lighting.

Meanwhile, the shapes of most of lighting apparatus to which the LED is applied are limited in accordance with the structure of the space in which the lighting apparatus is installed. Therefore, the field of use of the lighting apparatus or a kind of a space in which the lighting apparatus is used is increasing.

SUMMARY

One embodiment is a flat lighting module. The flat lighting module includes: a frame including a base and an extension portion extending from the base; a light source unit placed on the base, wherein the light source unit includes a plurality of light emitting devices; and a diffusion plate placed on the light source unit, wherein a light emitting device that is the closest to the extension portion among the plurality of the light emitting devices of the light source unit is disposed separately from the extension portion at a predetermined interval.

Another embodiment is a flat lighting module. The flat lighting module includes: a frame including a base and an extension portion which has an inclination with respect to the extension line of the surface of the base and extends from the base; and a light source unit including a substrate placed on the base and a plurality of light emitting devices placed on the substrate, wherein light with the maximum orientation angle among lights emitted from a light emitting device that is the closest to the extension portion among the plurality of the light emitting devices is at least not reflected by the extension portion.

Further another embodiment is a flat lighting assembly apparatus. The flat lighting assembly apparatus includes: a first flat lighting module and a second flat lighting module which are separated from each other and each include: a frame including a base and an extension portion extending from the base; a light source unit placed on the base, wherein the light source includes a plurality of light emitting devices; and a diffusion plate placed on the light source unit, wherein a light emitting device that is the closest to the extension portion among the plurality of the light emitting devices of the light source unit is disposed separately from the extension portion at a predetermined interval; a ceiling member to which a connector of the first flat lighting module and the second flat lighting module is coupled; and a power supply controller disposed within the ceiling member.

DETAILED DESCRIPTION

A thickness or size of each layer is magnified, omitted or schematically shown for the purpose of convenience and clearness of description. The size of each component does not necessarily mean its actual size.

It will be understood that when an element is referred to as being 'on' or "under" another element, it can be directly on/under the element, and one or more intervening elements may also be present. When an element is referred to as being 'on' or 'under', 'under the element' as well as 'on the element' can be included based on the element.

Hereinafter, an embodiment of the present disclosure will be described with reference to the accompanying drawings.

Figure 1:
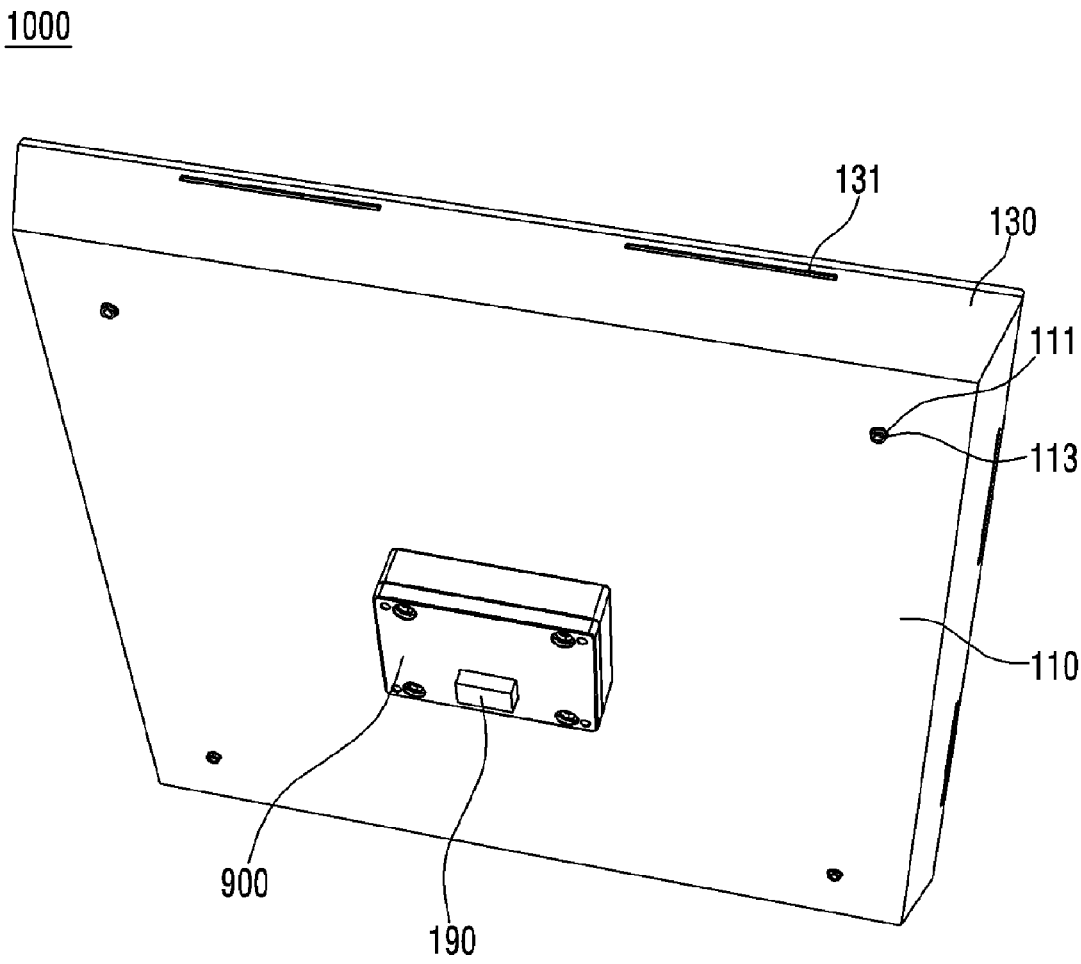
FIG. 1 is a perspective view of a flat lighting module according to an embodiment of the present disclosure.
Figure 2:
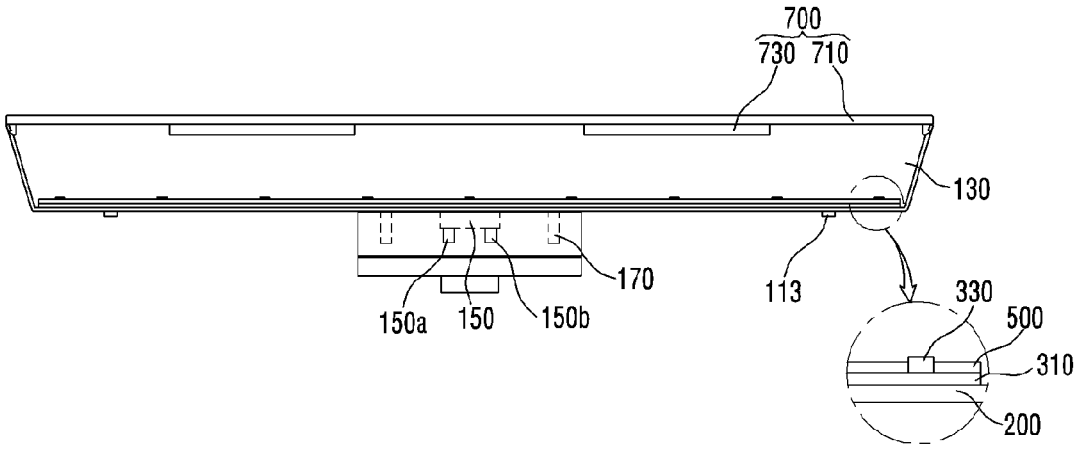
FIG. 2 is a cross sectional view of the flat lighting module according to the embodiment of the present disclosure.
Figure 3:
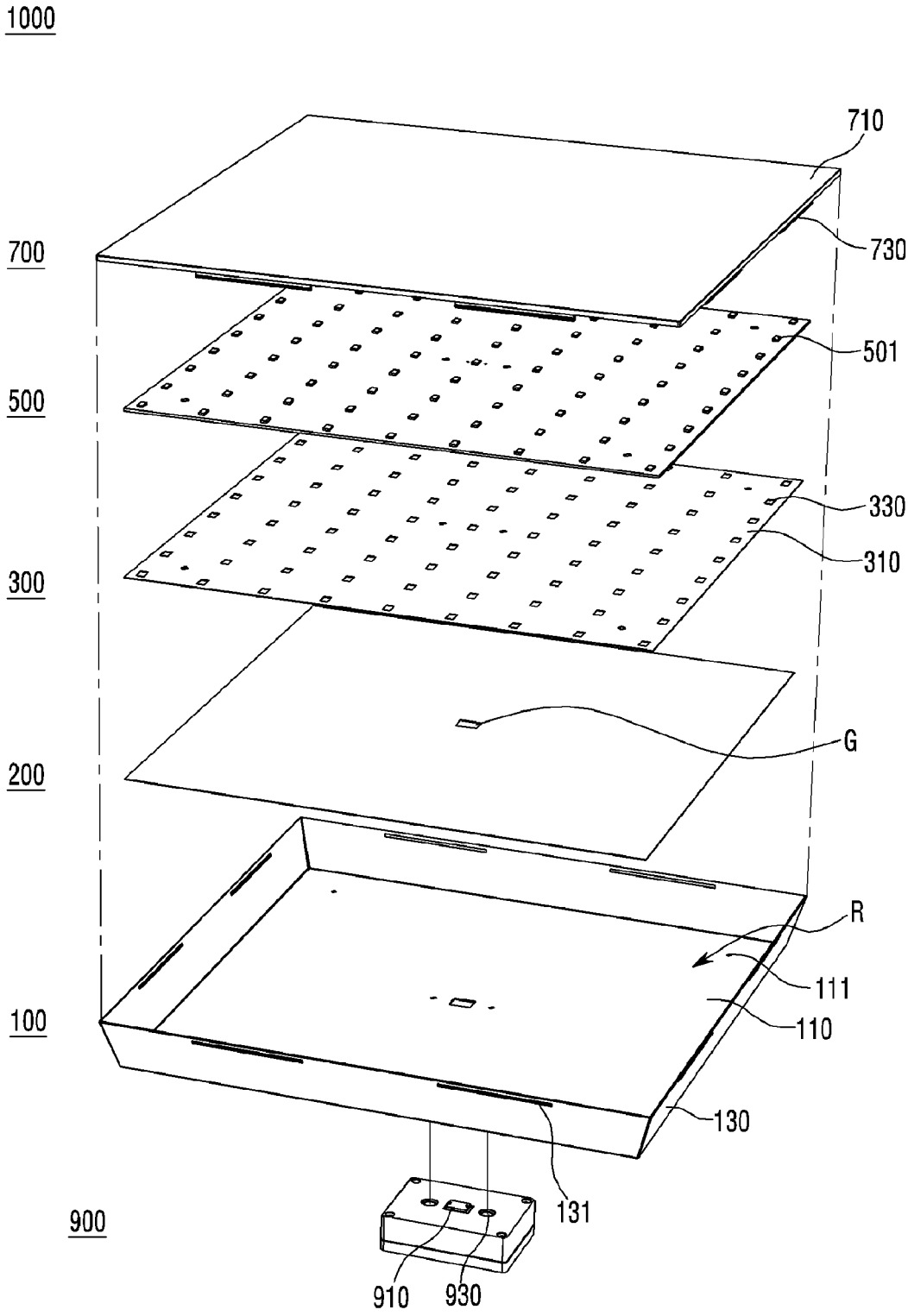
FIG. 3 is an exploded perspective view for describing a structure of the flat lighting module according to the embodiment of the present disclosure.

FIG. 1 is a perspective view of a flat lighting module according to an embodiment of the present disclosure. FIG. 2 is a cross sectional view of the flat lighting module according to the embodiment of the present disclosure. FIG. 3 is an exploded perspective view for describing a structure of the flat lighting module according to the embodiment of the present disclosure.

Referring to FIGS. 1 to 3, a flat lighting module 1000 includes a frame 100, a heat radiation sheet 200, a light source unit 300, a reflection plate 500, a diffusion plate 700 and a connector 900.

The frame 100 is formed by assembling a plurality of flanges or may be extrusion molded in the form of one member. The material of the frame 100 includes not only a plastic material such as polyvinyl chloride (PVC), but a conductive material such as metal which is capable of satisfactorily transferring heat generated from a light source unit to the outside. The frame 100 includes a base 110 and an extension portion 130.

The base 110 has a quadrangle plate shape of which corners have holes 111. The base 110 is screw-fastened 113 and coupled to the light source unit 300 through the holes 111. The center portion of the rear side of the base 110 is mechanically connected to a socket 150 for supplying electric power to the light source unit. One or more guides 170 are formed projecting around the socket 150 of center portion of the rear side of the base 110. The guide 170 has the same material as that of the base 110 and allows the socket 150 to be easily electrically connected to the connector 900.

The extension portion 130 extends from the four edges of the base 110 at a predetermined angle with respect to the surface of the base 110. Here, the predetermined angle is an obtuse angle. Therefore, the frame 100 includes a seat R formed by the base 110 and the extension portion 130. The extension portion 130 forms an obtuse angle with the surface of the base 110 in order to maximize luminous efficiency according to the orientation angle of light generated from the light source unit disposed in the seat. That is, the light generated from the light source unit is emitted having a predetermined orientation angle equal to or greater than 90° in order that the light is at least prevented from being blocked by the extension portion.

When the light emitted from the light source unit 300 is irradiated to the extension portion 130, the light is reflected to the diffusion plate 700 by coating a reflective material on the inner surface of the extension portion 130. Besides, at least one rectangular locking hole 131 is formed around the edge portions of the extension portion 130. A locking projection 730 to be described below of the diffusion plate 700 is inserted into and coupled to the locking hole.

The light source unit 300 includes a substrate 310 and a plurality of light emitting devices 330 mounted on the substrate 310.

The substrate 310 may have no limit in its shape so that it may have a structure corresponding to the shape of the base 110 of the frame 100. The substrate 310 is formed by printing a circuit pattern on an insulator. For example, in embodiments the substrate 310 includes not only a printed circuit board (PCB), a metal core PCB, a flexible PCB, a ceramic PCB and the like but also a chips on board (COB) allowing an unpackaged LED chip to be directly bonded thereon. The substrate 310 is made of a material efficiently reflecting light. Otherwise, the surface of the substrate 310 may have a color by which light is efficiently reflected, for example, white and silver, etc.

The plurality of the light emitting devices 330 are arranged on the substrate in a strip pattern. Each of the plurality of the light emitting devices 330 can include at least one light emitting diode (LED). The LED may correspond to a red LED, green LED, blue LED or white LED, each of which emits red, green, blue or white light respectively. There is no limit to the kind and the number of the LEDs.

Meanwhile, a heat radiation sheet 200 is disposed between the light source unit 300 and the base 110 of the frame 110. The heat radiation sheet 200 includes a thermal conductive material, so that heat generated from the light source unit 300 is transferred to the frame 300 and radiated to the outside. In consideration of an electrical connection path between the light source unit 300 and the connector 900, the heat radiation sheet 200 also includes an opening G which is formed in an area corresponding to an area in which a connector is disposed.

The reflection plate 500 includes a plurality of holes 501 of which the number is the same as that of the plurality of the light emitting devices 330 disposed on the substrate 310. The reflection plate 500 is placed on the light source unit 300 such that the plurality of the light emitting devices are disposed in the plurality of the holes 501 respectively so that light from the light emitting devices are exposed. In other words, the reflection plate 500 is disposed on the light source unit 300 such that the plurality of the light emitting devices 330 are exposed outward through the plurality of the holes 501. When light emitted from the light source unit 300 is emitted to the outside through the diffusion plate 700, the reflection plate 500 re-reflects the light reflected by the diffusion plate 700 and transmits the light to the outside.

The reflection plate 500 can be made of a metallic material or a resin material which has a high reflection efficiency. For example, the resin material includes any one of polyethylene terephthalate (PET), polycarbonate (PC), or PVC resin. The metallic material includes at least one of Ag, an alloy including Ag, Al or an alloy including Al.

The surface of the reflection plate 500 is coated with Ag, Al, white photo solder resist (PSR) ink and a diffusion sheet and the like. Otherwise, an oxide layer is formed on the surface of the reflection plate 500 by an anodizing process. However, there is no limit to the material and color of the reflection plate 500. The material and color of the reflection plate 500 can be variously selected according to the illumination implemented by the flat lighting module 1000.

The diffusion plate 700 diffuses the light emitted from the light source unit 300 and emits the light to the outside. The diffusion plate 700 includes a base plate 710 having the same shape as that of the light source unit 300 or the reflection plate 500. Besides, at least one locking projection 730 is disposed on the edge of the base plate 710. Such a diffusion plate 700 is disposed over the reflection plate 500, and the locking projection 730 of the diffusion plate inserted into the locking hole 131 of the frame, so that the diffusion plate 700 is mechanically coupled to the frame 100. Meanwhile, the locking projection 730 of the diffusion plate is inserted and coupled to the locking hole 131 of the extension portion 130 of the frame in a direction from the inside to the outside of the extension portion. This intends to obtain structural stability.

The diffusion plate 700 is spaced apart from and over the light source unit 300. Here, the diffusion plate is disposed in a position that prevents a light spot of the light emitted from the light emitting device of the light source unit 300 from being generated in the base plate 710 of the diffusion plate. That is to say, although the diffusion plate 700 may be disposed as close as possible to the light source unit, the diffusion plate 700 is disposed at a position that prevents a light spot from being generated. Further, the diffusion plate 700 is thick enough to prevent darkness from being generated on the edge thereof. The diffusion plate 700 may be at least thicker than the substrate 310 of the light source unit.

Meanwhile, a diffusing lens (not shown) may be disposed on the diffusion plate 700 so as not to generate darkness on the edge of the diffusion plate.

The diffusion plate 700 is made of a plastic material such as polypropylene (PP) and polyethylene (PE), etc. unlike that of the frame in order to obtain fixability and stability after the lighting module is installed. Among the plastic materials, polycarbonate (PC) having high light resistance, high thermal resistance and excellent impact strength property can be used as the material of the diffusion plate 700.

The connector 900 is electrically connected to the socket 150 in order to supply electric power to the light source unit 300 through the socket 150. The connector 900 includes a first insertion groove 910 and a second insertion groove 930. The connector 900 is electrically connected to the socket 150 by inserting the socket 150 into the first insertion groove 910 formed on one side of the connector 900. The connector 900 is mechanically coupled to the frame 100 by inserting the guide 170 projecting at the center portion of the rear side of the base 110 of the frame 100 into the second insertion groove 930. Besides, the other side of the connector 900 includes a protruding member 190 that is mechanically connected to a ceiling or the surface of a wall.

Figure 4:
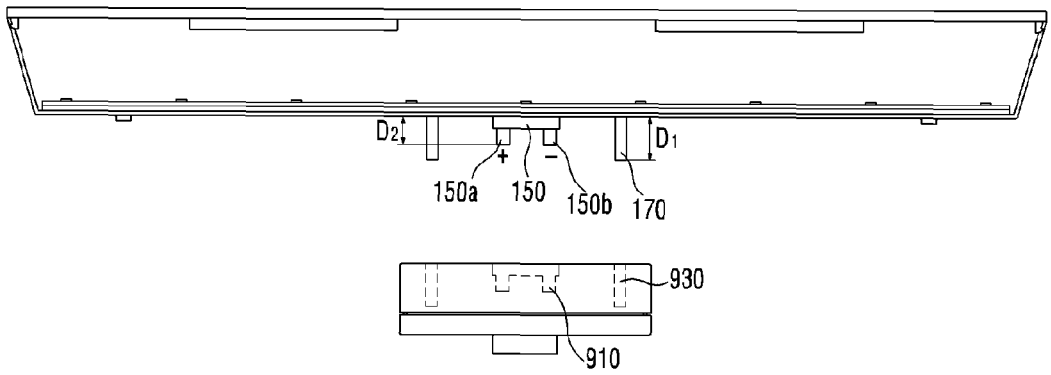
FIG. 4 is shows embodiment of the present disclosure and how a socket of the flat lighting module is connected to a connector of the flat lighting module.

FIG. 4 shows an embodiment of the present disclosure and how the socket of the flat lighting module is connected to the connector of the flat lighting module.

As shown, the socket 150 disposed on the rear side of the frame 100 includes a first electrode 150*a* to which positive voltage is supplied and a second electrode 150 to which negative voltage is supplied. The socket 150 is inserted into the first insertion groove 910 of the connector, so that the socket is electrically connected to the connector. Here, the electrical connection is established by using a push-pull method.

Meanwhile, the plurality of the guides 170 are formed around the socket 150 on the rear side of the frame. The guides 170 may have mutually different shapes from each other. The guides 170 have cylindrical shapes having mutually different diameters from each other. This makes it easier to cause the socket 150 and the connector 900 to be electrically connected to each other with correct polarities. That is, when the plurality of the guides 170 have mutually different shapes from each other, it is easy to distinguish the position of the first electrode 150*a* from that of the second electrode 150*b*, so that the socket 150 is connected in a stable manner to the connector 900 without an electrical short-circuit.

Further, a distance D1 from one end to the other end of the guide 170 is greater than a distance D2 from one end to the other end of the socket 150. This is because first of all the guide 170 should be correctly inserted into the second insertion groove 930 of the connector in order to accurately align the socket 150 with the guide 170 when the socket 150 and the guide 170 are connected to the first insertion groove 910 and the second insertion groove 930 respectively. Therefore, mechanically, the entire length of the guide 170 needs to be greater than that of the socket 150. If not, the socket 150 and the connector 900 may be electrically connected to each other with incorrect polarities, so that the electrical short-circuit may occur.

Figure 5:
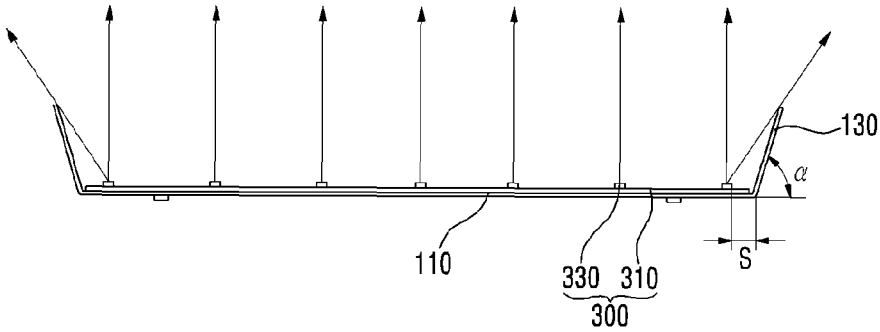
FIG. 5 is an embodiment of the present disclosure and is a view for describing an arrangement structure of the light source unit.

FIG. 5 is an embodiment of the present disclosure and is a view for describing an arrangement structure of the light source unit.

As shown, the light source unit 300 is disposed on the base 110 of the frame 100. Here, the light emitting devices that are the closest to the extension portion 130 of the frame 100 among the plurality of the light emitting devices 330 of the light source unit 300 are disposed separately from the extension portion 130 at a predetermined interval S. The predetermined interval S is at least 5 mm. The aforementioned numerical range is intended to obtain at least work efficiency when the light source unit 300 is disposed on the extension portion 130 of the frame 100.

The light emitting devices are disposed separately from the extension portion 130 at the predetermined interval so that light with the maximum orientation angle among all light emitted from the light emitting devices 330 is at least not reflected by the extension portion. Thus, the luminous efficiency of the flat lighting module can be hereby improved. When the light emitted from the light emitting devices 330 is directly irradiated to the extension portion, darkness may occur around the edge of the diffusion plate.

The surface of the extension portion 130 is inclined at an acute angle ($\alpha$) with respect to the extension line of the surface of the base 110. This intends to maximally reduce the darkness occurring around the edge of the diffusion plate, when the flat lighting module is operated. Here, it is desirable that the acute angle is between 65° and 75°. This is because it is possible to reduce the darkness and to assemble a plurality of the flat lighting modules in a mechanically stable manner.

Such a flat lighting module itself can be used as a lighting apparatus.

Figure 6:
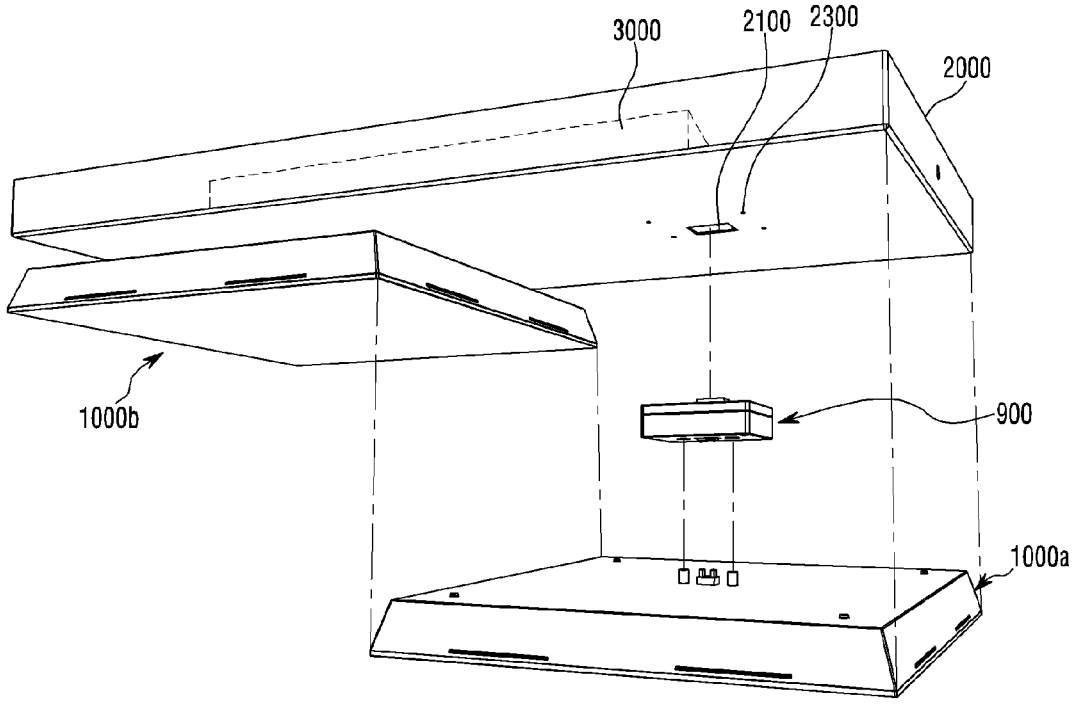
FIG. 6 is an embodiment of the present disclosure and is an exploded perspective view of a flat lighting assembly apparatus including a plurality of flat lighting modules.
Figure 7:
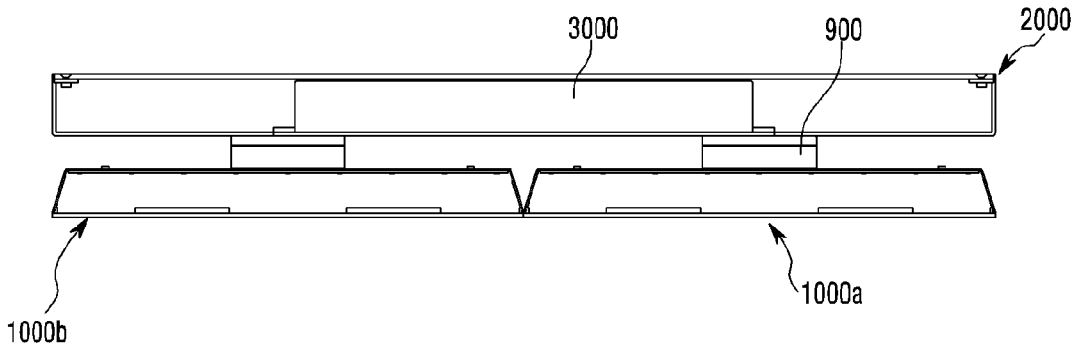
FIG. 7 is an embodiment of the present disclosure and is a cross sectional view of the flat lighting assembly apparatus including the plurality of flat lighting modules.

FIG. 6 is an embodiment of the present disclosure and is an exploded perspective view of a flat lighting assembly apparatus including a plurality of the flat lighting modules. FIG. 7 is an embodiment of the present disclosure and is a cross sectional view of the flat lighting assembly apparatus including the plurality of the flat lighting modules.

Referring to FIGS. 6 and 7, a flat lighting assembly apparatus includes a first flat lighting module 1000*a*, a second flat lighting module 1000*b*, a ceiling member 2000, and a power supply controller 3000.

Since the first flat lighting module 1000*a* and the second flat lighting module 1000*b* have been described in FIGS. 1 to 3, descriptions thereof will be omitted. Here, the first flat lighting module 1000*a* and the second flat lighting module 1000*b* may be disposed at a regular interval. Heat generated at the time of operating the flat lighting modules is effectively radiated through the separation interval.

The ceiling member 2000 is a quadrangular shaped case and includes a groove 2100 allowing the ceiling member 2000 to be mechanically coupled to the protruding member of the connector. For the purpose of mechanically stable coupling of the ceiling member 2000, the ceiling member 2000 also includes a plurality of holes 2300 which are formed around the groove 2100 thereof and are used to fasten a screw (not shown) to the connector 900.

As such, in a mechanical coupling between the ceiling member 2000 and the connector 900 of the flat lighting module, the flat lighting module is attachable to and removable from the ceiling member 2000 if necessary, so that it is possible to increase spatial utilization in the disposition of the lighting apparatus.

The power supply controller 3000 controls the power supply of each of the flat lighting modules and is disposed within the ceiling member 2000. The disposition area of the power supply controller 3000 can be changed in consideration of mechanical stability, heat radiating characteristics, and the like.

The features, structures and effects and the like described in the embodiments are included in at least one embodiment of the present disclosure and are not necessarily limited to one embodiment. Furthermore, the features, structures and effects and the like provided in each embodiment can be combined or modified in other embodiments by those skilled in the art to which the embodiments belong. Therefore, the contents related to the combination and modification should be construed to be included in the scope of the present disclosure.

Although embodiments of the present disclosure were described above, these are just examples and do not limit the present disclosure. Further, the present disclosure may be changed and modified in various ways, without departing from the essential features of the present disclosure, by those skilled in the art. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A flat lighting assembly apparatus comprising:

a first flat lighting module and a second flat lighting module which are separated from each other and each include:

a frame including a base and an extension portion extending from the base;

a light source placed on the base, wherein the light source includes a plurality of light emitting devices; and a diffusion plate placed on the light source, wherein a light emitting device that is the closest to the extension portion among the plurality of the light emitting devices of the light source is disposed separately from the extension portion at a predetermined interval;

a ceiling member to which a connector of the first flat lighting module and the second flat lighting module is coupled; and a power supply controller disposed within the ceiling member, wherein the light emitting devices include an LED, and wherein the connector is electrically connected to a socket disposed on the rear side of the base in order to supply electric power from the outside to the light source and includes a coupling unit coupled to at least one guide disposed around the socket.

2. The flat lighting assembly apparatus of claim 1, wherein the light emitting device closest to the extension portion emits light toward the diffusion plate directly.

3. The flat lighting assembly apparatus of claim 1, wherein the predetermined interval is at least 5 mm.

4. The flat lighting assembly apparatus of claim 1, wherein a surface of the extension portion is inclined at an acute angle with respect to a line extended from the surface of the base.

5. The flat lighting assembly apparatus of claim 4, wherein the acute angle is between 65° and 75°.

6. The flat lighting assembly apparatus of claim 1, wherein the frame comprises a reflective material coated on an inner surface of the extension portion.

7. The flat lighting assembly apparatus of claim 1, wherein the extension portion of the frame comprises at least one locking hole, wherein the diffusion plate comprises at least one locking projection disposed on the edge thereof, and wherein the locking projection of the diffusion plate is coupled to the locking hole of the extension portion of the frame.

8. The flat lighting assembly apparatus of claim 7, wherein the locking projection of the diffusion plate is inserted and coupled to the locking hole of the extension portion of the frame in a direction from the inside to the outside of the extension portion.

9. The flat lighting assembly apparatus of claim 1, wherein each of the first and second flat lighting modules further comprises a heat radiation sheet disposed between the light source and the base of the frame.

10. The flat lighting assembly apparatus of claim 1, wherein each of the first and second flat lighting modules further comprises:

a socket disposed on the rear side of the base for the purpose of supplying electric power to the light source;

at least one guide disposed around the socket; and a connector being electrically connected to the socket in order to supply electric power from the outside and including a coupling unit coupled to the guide.

11. The flat lighting assembly apparatus of claim 10, wherein the socket is disposed around the center portion of the base, and wherein the socket and the connecter are connected with each other by using a push-pull method.

12. The flat lighting assembly apparatus of claim 10, wherein a plurality of the guides are provided and the guides have mutually different shapes from each other.

13. The flat lighting assembly apparatus of claim 10, wherein a plurality of the guides are provided and the guides have cylindrical shapes having mutually different diameters from each other.

14. The flat lighting assembly apparatus of claim 10, wherein a distance from a first end to a second end of the guide is greater than a distance from a first end to a second end of the socket measured perpendicularly to the base.

15. The flat lighting assembly apparatus of claim 10, wherein the guide is formed to project from the rear side of the base, and wherein the coupling unit has a shape into which the projecting guide is inserted.

16. The flat lighting assembly apparatus of claim 1, wherein the diffusion plate is at least thicker than the substrate of the light source.

17. The flat lighting assembly apparatus of claim 1, wherein each of the first and second flat lighting modules further comprises a reflection plate including a plurality of holes and being disposed on the light source such that the plurality of the light emitting devices are disposed in the plurality of the holes respectively so that light from the light emitting devices is exposed.

18. The flat lighting assembly apparatus of claim 1, wherein the diffusion plate is spaced apart from and over the light source such that a light spot of the light emitted from the light emitting devices is not generated at least in the diffusion plate.

* * * * *